US006353211B1

(12) United States Patent
Chen

(10) Patent No.: US 6,353,211 B1
(45) Date of Patent: Mar. 5, 2002

(54) ELECTRIC HEATING DEVICE

(76) Inventor: Ching-Song Chen, No. 29, 21st. Rd. Industrial Park, Taichung City (TW)

( * ) Notice: Subject to any disclaimer, the term of this patent is extended or adjusted under 35 U.S.C. 154(b) by 0 days.

(21) Appl. No.: 09/828,224

(22) Filed: Apr. 9, 2001

(51) Int. Cl.[7] ..... H05B 3/54

(52) U.S. Cl. ..... 219/527; 219/527; 219/211; 219/535

(58) Field of Search ..... 219/211, 527, 219/528, 535, 529, 544, 549

(56) References Cited

U.S. PATENT DOCUMENTS 1,162,363 A * 11/1915 Ingersoll ..... 219/528
1,594,053 A * 7/1926 Evans ..... 219/527
2,617,916 A * 11/1952 Neidnig ..... 219/527
3,079,486 A * 2/1963 Winchell ..... 219/528
3,407,818 A * 10/1968 Costanzo ..... 219/211
3,569,666 A * 3/1971 Murphy et al. ..... 219/211
3,955,063 A * 5/1976 Berger ..... 219/211
4,042,803 A * 8/1977 Bickford ..... 219/211
4,065,660 A * 12/1977 Berard ..... 219/535
4,107,509 A * 8/1978 Scher et al. ..... 607/108
4,201,218 A * 5/1980 Feldman et al. ..... 607/112
4,279,255 A * 7/1981 Hoffman ..... 607/112
4,532,410 A * 7/1985 Wehmeyer ..... 219/211
4,702,235 A * 10/1987 Hong ..... 602/13
4,736,088 A * 4/1988 Bart ..... 219/211
5,436,429 A * 7/1995 Cline ..... 219/202
5,891,189 A * 4/1999 Payne, Jr. ..... 607/108
5,928,275 A * 7/1999 Yates et al. ..... 607/112

* cited by examiner

*Primary Examiner*—Joseph Pelham
(74) *Attorney, Agent, or Firm*—Baker Botts L.L.P.

(57) ABSTRACT

An electric heating device includes a heating member, a closure unit and an electric wire unit. The heating member is formed as a flexible sheet with opposite first and second end portions. The heating member has upper and lower dielectric layers and an electric heating film layer which is disposed between the upper and lower dielectric layers and which generates heat when supplied with electric power. The closure unit is provided on the first and second end portions of the heating member for connecting the first and second end portions to each other so as to form the heating member into a tubular body and so as to retain a tubular shape of the heating member. The electric wire unit is connected electrically to the electric heating film layer, and is adapted to be connected electrically to an electric power source.

12 Claims, 6 Drawing Sheets

ELECTRIC HEATING DEVICE

BACKGROUND OF THE INVENTION

1. Field of the Invention

The present invention relates to an electric heating device, more particularly to an electric heating device suitable for heating or warming different body parts.

2. Description of the Related Art

Electric heating devices, such as an electric blanket, are in common use for warming body parts. However, since a conventional electric blanket is typically formed as a flat pad, it is only suitable for use on certain body parts, such as on upper or lower back portions. Moreover, the conventional electric blanket is typically supplied with electric power by plugging a plug into a commercial AC socket. As such, the conventional electric blanket can only be used indoors.

SUMMARY OF THE INVENTION

Therefore, the main object of the present invention is to provide an electric heating device suitable for heating or warming different body parts.

Accordingly, the electric heating device of the present invention includes a heating member, a closure unit and an electric wire unit. The heating member is formed as a flexible sheet with opposite first and second end portions. The heating member includes upper and lower dielectric layers and an electric heating film layer which is disposed between the upper and lower dielectric layers and which is adapted to generate heat when supplied with electric power. The closure unit is provided on the first and second end portions of the heating member for connecting the first and second end portions to each other so as to form the heating member into a tubular body and so as to retain a tubular shape of the heating member. The electric wire unit has a first end extending into the heating member and connected electrically to the electric heating film layer, and a second end opposite to the first end and adapted to be connected electrically to an electric power source.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
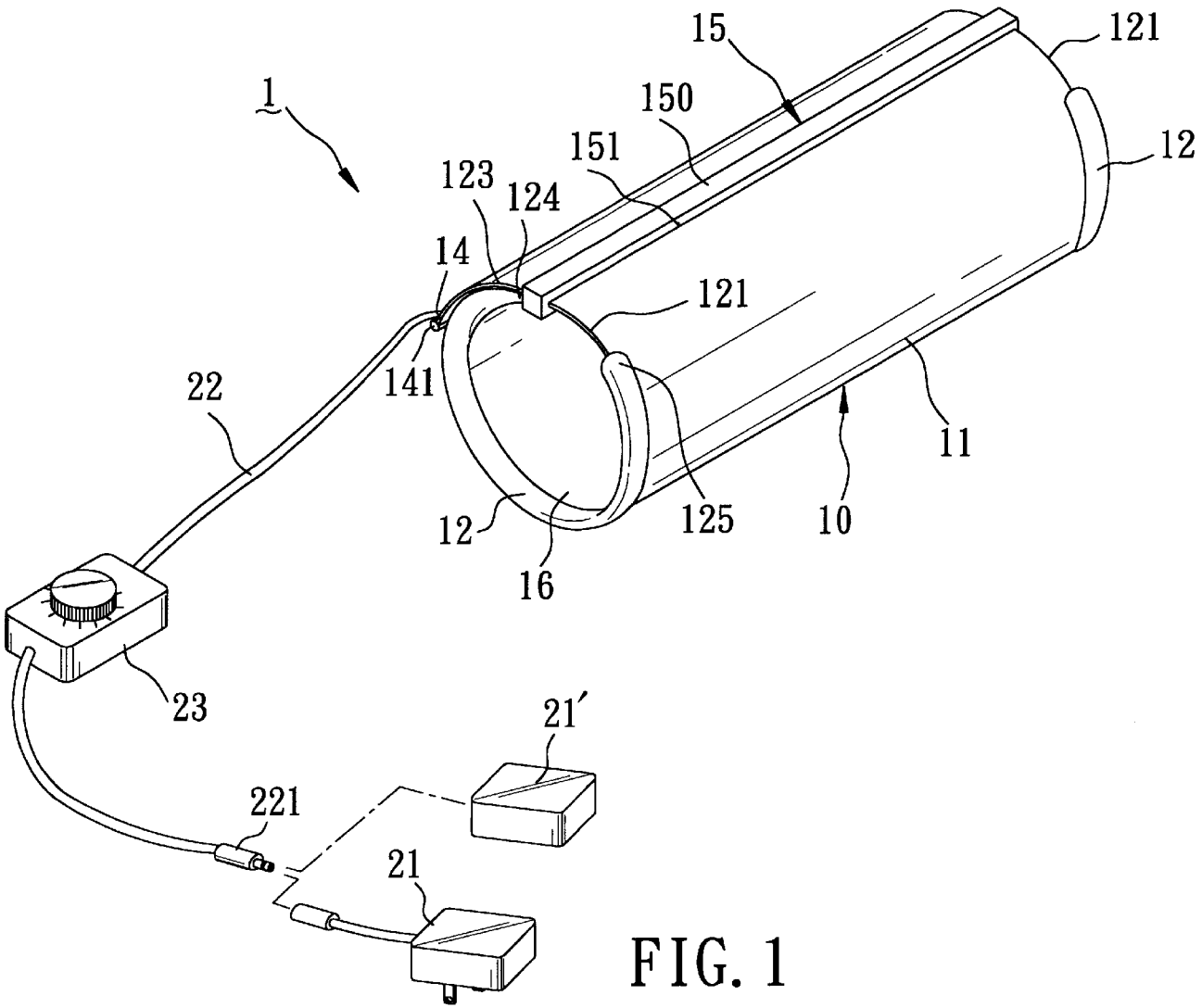
FIG. 1 is a partly exploded perspective view illustrating a first preferred embodiment of the electric heating device of the present invention.

Before the present invention is described in greater detail, it should be noted that like elements are denoted by the same reference numerals throughout the disclosure.

Figure 2:
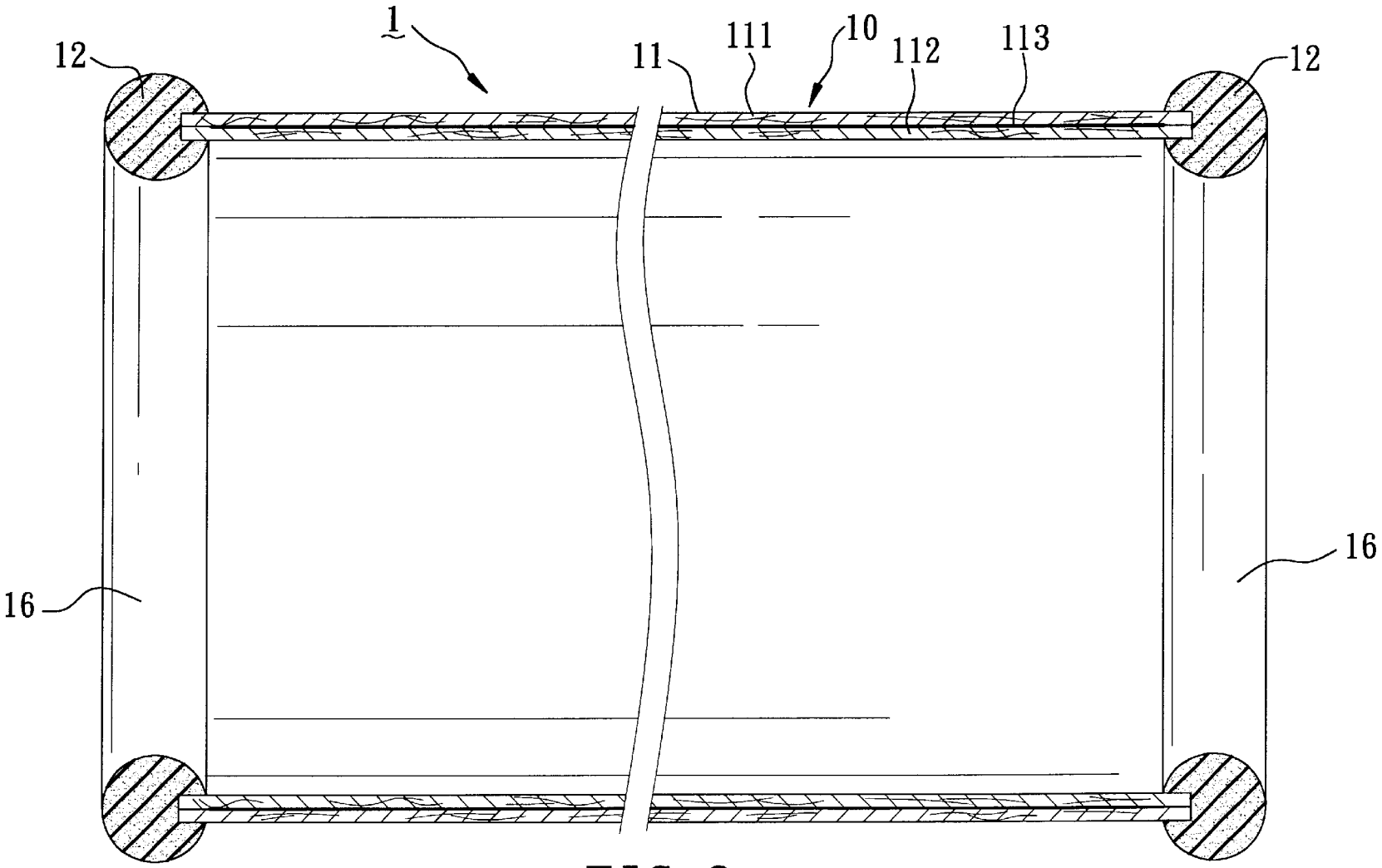
FIG. 2 is a longitudinal sectional view illustrating a heating member of the electric heating device of the first preferred embodiment.
Figure 3:
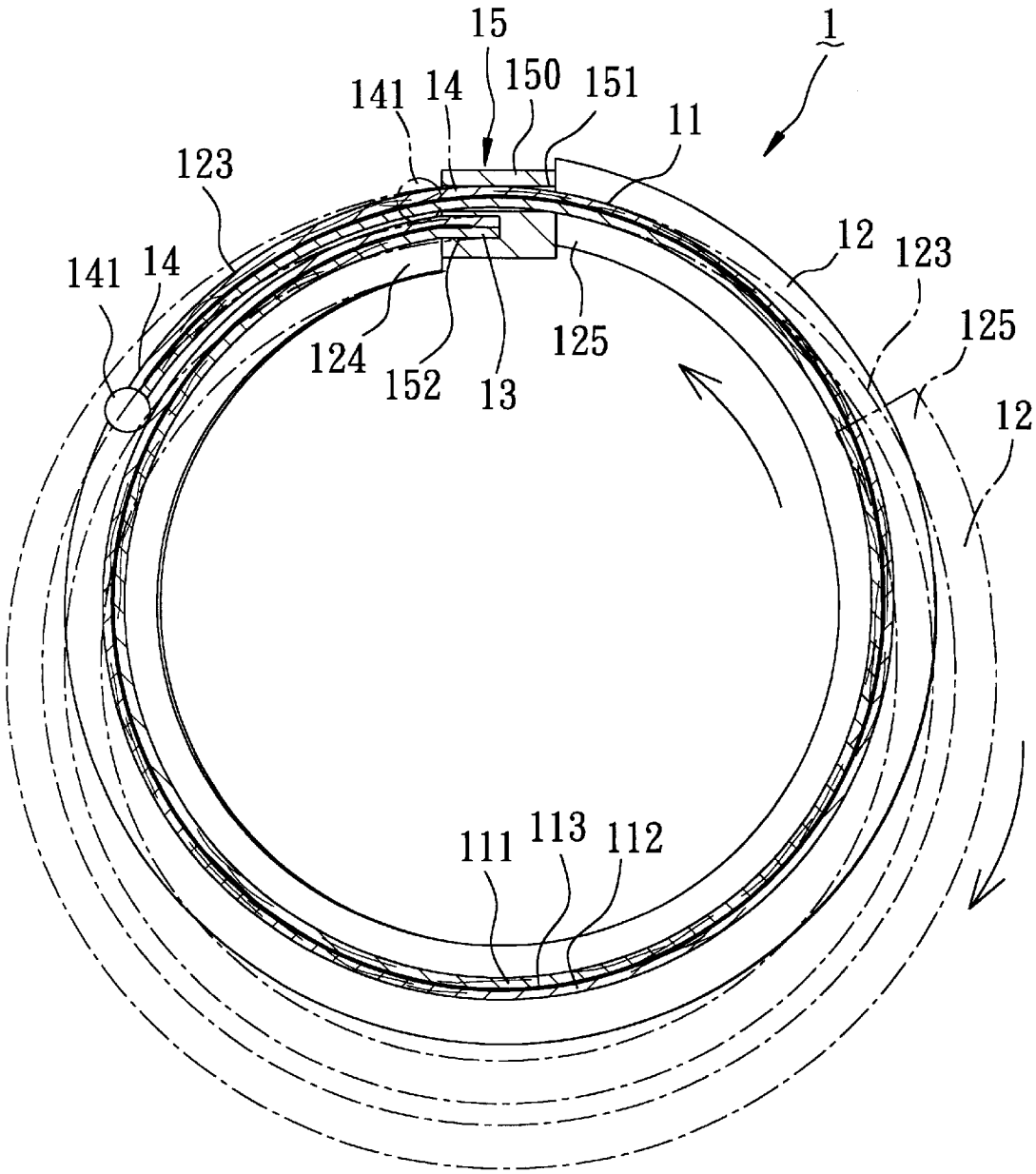
FIG. 3 is a cross-sectional view illustrating the heating member and a closure unit of the first preferred embodiment.

Referring to FIGS. 1 to 3, the first preferred embodiment of the heating device 1 of the present invention is shown to include a heating member 10, a closure unit 15 and an electric wire unit 22.

The heating member 10 is formed by winding a flexible sheet 11 into a tubular body with opposite open ends 16. The flexible sheet 11 includes upper and lower dielectric layers 111, 112 formed from a glass fiber material, which is relatively flexible, and an electric heating film layer 113 disposed between the upper and lower dielectric layers 111, 112. The electric heating film layer 113 is capable of generating heat in a known manner when it is supplied with electric power. The upper and lower dielectric layers 111, 112 are heat-sealed to each other at peripheral portions thereof so as to cooperatively enclose the electric heating film layer 113.

The flexible sheet 11 has opposite first and second end portions 13, 14, and a pair of opposite edge portions 121 which extend between the first and second end portions 13, 14 and which define the open ends 16 of the tubular body, respectively. A pair of resilient rings 12 a remounted respectively on the opposite edge portions 121, and extend respectively around the open ends 16 of the tubular body. The closure unit 15 includes an elongated connecting block 150 formed with a longitudinal blind groove 152 which has the first end portion 13 of the flexible sheet 11 received fixedly therein. The connecting block 150 further has a longitudinal slot 151 which is formed through opposite longitudinal edges of the connecting block 150 and which permits the second end portion 14 of the flexible sheet 11 to extend therethrough. A stop member, which is formed as an elongated strip 141, is provided on the second end portion 14 of the flexible sheet 11. The elongated strip 141 has a cross-sectional size larger than the width of the longitudinal slot 151 so as to prevent removal of the second end portion 14 of the flexible sheet 11 from the connecting block 150 via the longitudinal slot 151. By means of the connecting block 150 and the elongated strip 141, the flexible sheet 11 can be retained in a tubular shape. The second end portion 14 of the flexible sheet 11 is slidable relative to the connecting block 150 so as to permit adjustment in the diameter of the tubular body. Each of the resilient rings 12 has a first end 124 disposed adjacent to the first end portion 13 of the flexible sheet 11, and a second end 125 opposite to the first end 124. Each of the opposite edge portions 121 of the flexible sheet 11 has a section 123 which is free of the resilient ring 12 and which is disposed between the second end 125 of the resilient ring 12 and the elongated strip 141 so as not to block sliding movement of the second end portion 14 of the flexible sheet 11 relative to the connecting block 150. As best illustrated in FIG. 3, the second ends 125 of the resilient rings 12 abut against one of the longitudinal edges of the connecting block 150 when the tubular body is adjusted to have a smallest diameter. The elongated strip 141 abuts against the other one of the longitudinal edges of the connecting block 150 when the tubular body is adjusted to have a largest diameter.

Referring back to FIG. 1, the electric wire unit 22 has a first end which extends into the flexible sheet 11, before the upper and lower dielectric layers 111, 112 are heat-sealed to each other, and which is connected electrically to the electric heating film layer 113, and an opposite second end 221 connected to an electric power adapter 21 or a battery casing 21'. The electric power adapter 21 is adapted to be plugged into a receptacle (not shown) such that the electric heating film layer 113 can be supplied with electric power. The battery casing 21' is adapted for receiving a battery set (not shown), thereby permitting the heating device 1 to be carried by the user. The electric wire unit 22 is wrapped with an insulating layer of silica gel material to prevent electric leakage. Preferably, a known temperature regulator 23 is connected electrically to the electric wire unit 22 to permit regulation of the temperature of the heating member 10.

The electric heating device 1 of the present embodiment is adapted to be used on different body parts, such as upper or lower arm portions or legs of the user. The diameter of the tubular body of the heating member 10 is adjustable according to the size of the body part to which the heating device 1 is to be applied. The resilient rings 12 are adapted to be in contact with the skin on the body part so as to retain the heating device 1 on the body part.

The heating device 1 of the present embodiment may also be disposed around a milk bottle or a water bottle for warming the same.

Figure 4:
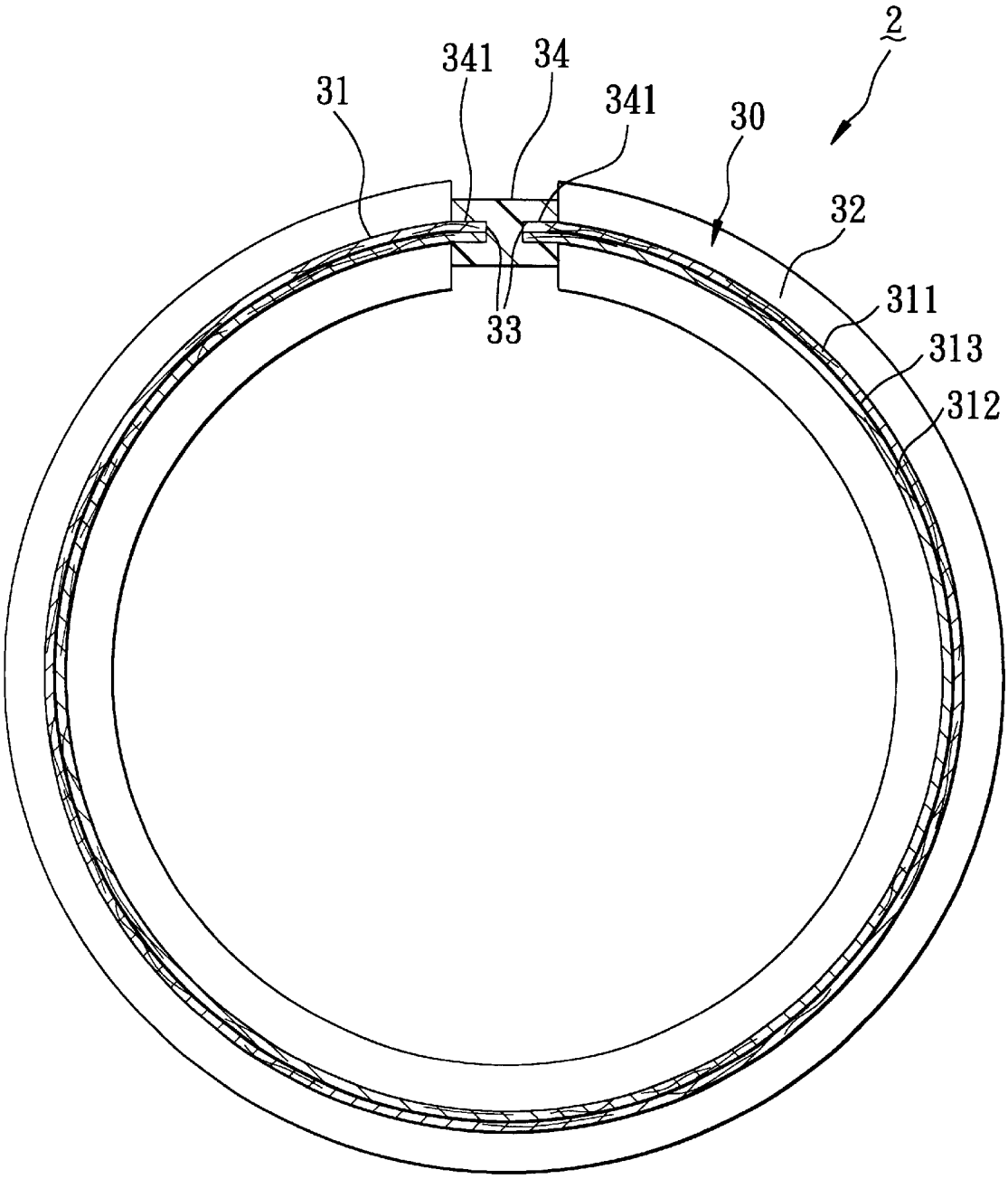
FIG. 4 is a cross-sectional view illustrating a heating member of a second preferred embodiment of the electric heating device of the present invention.

Referring to FIG. 4, the second preferred embodiment of the electric heating device 2 of the present invention is shown to have a structure similar to that of the previous embodiment. However, unlike the previous embodiment, the closure unit is formed as an elongated connecting block 34 having a longitudinal blind groove 341 formed in each of its two opposite longitudinal edges, for receiving fixedly a respective one of the opposite first and second end portions 33 of the flexible sheet 31 of the heating member 30 so as to form the heating member 30 into a tubular body with a fixed cross-sectional size and so as to retain a tubular shape of the heating member 30. As with the previous embodiment, the flexible sheet 31 includes upper and lower dielectric layers 311, 312 and an electric heating film layer 313 which is disposed between and enclosed by the dielectric layers 311, 312 and which is connected to an electric wire unit (not shown in FIG. 4). A pair of resilient rings 32 are provided on open ends of the tubular body.

Figure 5:
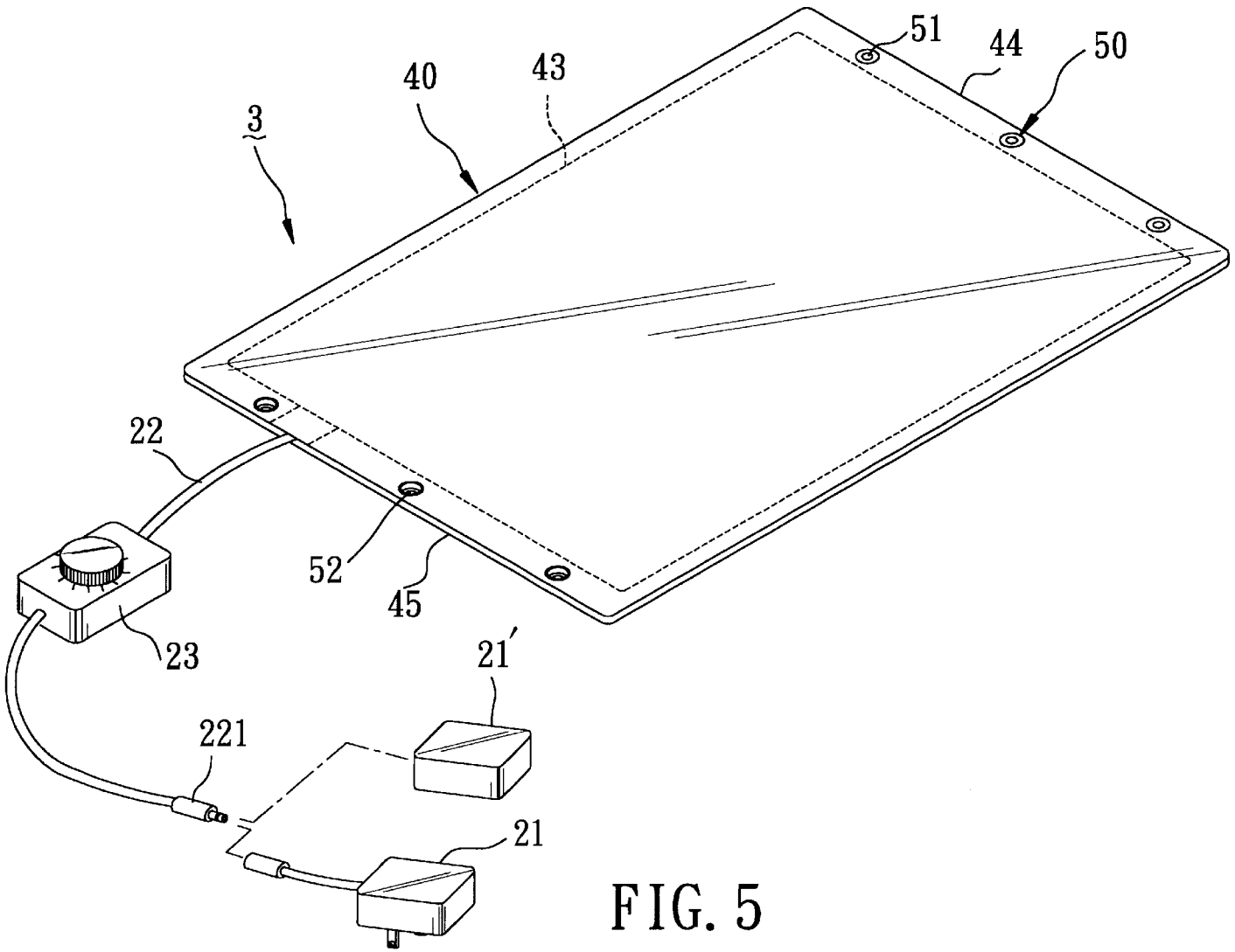
FIG. 5 is a partly exploded perspective view illustrating a third preferred embodiment of the electric heating device of the present invention, where a heating member is shown to be in an unrolled state.
Figure 6:
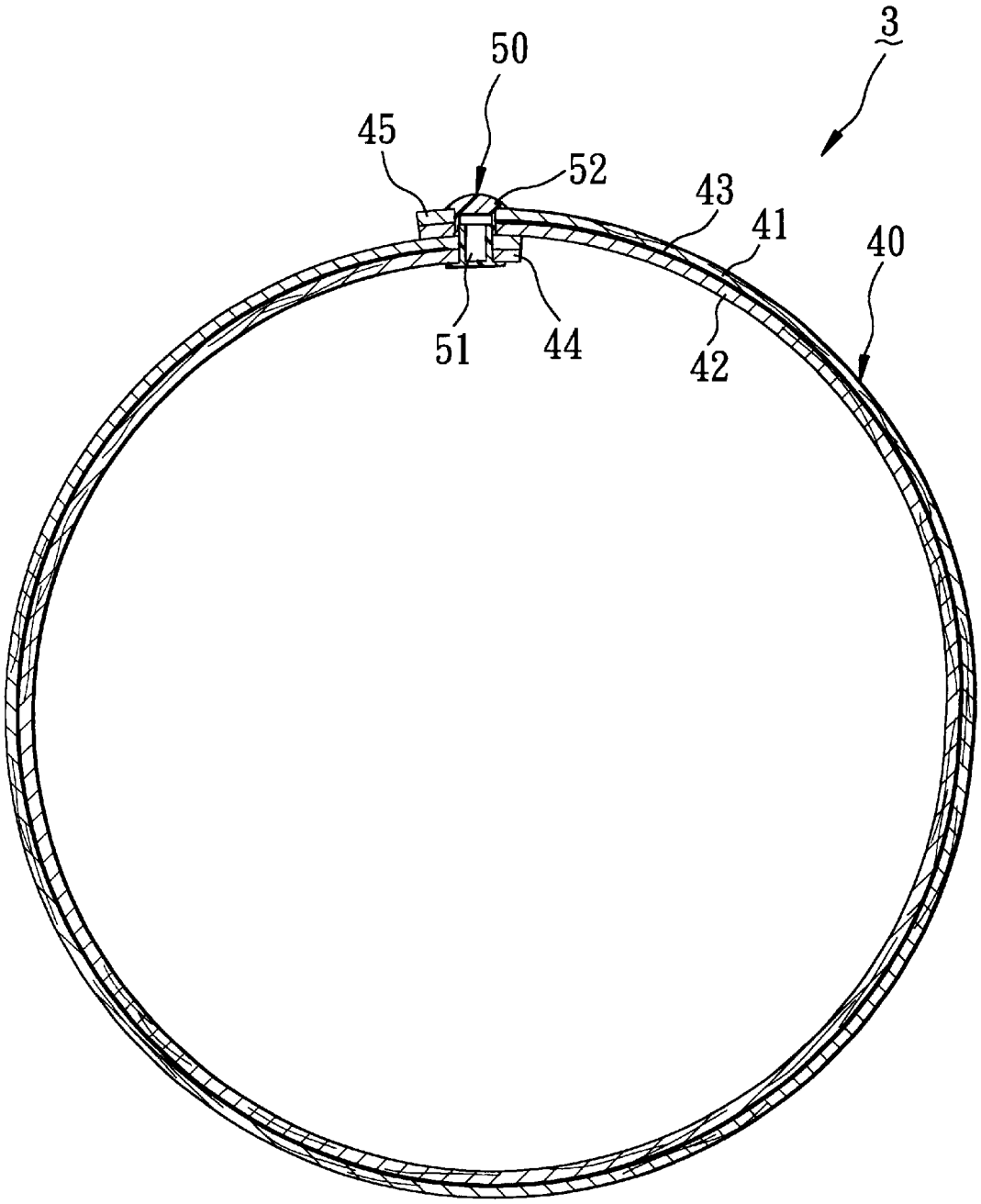
FIG. 6 is a cross-sectional view illustrating a heating member of the electric heating device of the third preferred embodiment, where the heating member is shown to be in a rolled-up state.

Referring to FIGS. 5 and 6, the third preferred embodiment of the electric heating device 3 of the present invention is shown to include a heating member 40 formed as a flexible sheet, a closure unit 50, and an electric wire unit 22. As with the first preferred embodiment, the flexible sheet of the heating member 40 similarly includes upper and lower dielectric layers 41, 42 which are heat-sealed to each other at peripheral portions thereof, and an electric heating film layer 43 which is disposed between and enclosed by the upper and lower dielectric layers 41, 42 and which is connected electrically to the electric wire unit 22.

The closure unit 50 includes a set of female buttons 52 provided on a first end portion 45 of the flexible sheet, and a set of male buttons 51 provided on a second end portion 44 of the flexible sheet opposite to the first end portion 45 for engaging the female buttons 52 respectively and releasably. When the female buttons 52 engage the male buttons 51, the heating member 40 is rolled-up and is formed into a tubular body, as shown in FIG. 6. At this time, the heating device 3 can be used on upper or lower arm portions or legs of the user, as with the foregoing embodiments. When the female buttons 52 are detached from the male buttons 51, the heating member 40 can be unrolled so as to be formed into a flat pad. At this time, the heating device 3 can be used on other body parts, such as upper or lower back portions of the user.

Preferably, each of the upper and lower dielectric layers of the flexible sheet is formed to have a thickness of about 0.1 mm, and the electric heating film layer is formed to be much thinner than the dielectric layers such that the thickness of the flexible sheet is relatively thin. Moreover, by forming the dielectric layers from glass fiber, the heating device can be relatively light-weight. Furthermore, the dielectric layers formed from glass fiber are waterproof, are chemical resistant, and are thus relatively durable to ensure long-term use of the electric heating device.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electric heating device comprising:

a heating member formed as a flexible sheet with opposite first and second end portions, said heating member including upper and lower dielectric layers and an electric heating film layer which is disposed between said upper and lower dielectric layers and which is adapted to generate heat when supplied with electric power;

a closure unit provided on said first and second end portions of said heating member for connecting said first and second end portions to each other so as to form said heating member into a tubular body and so as to retain a tubular shape of said heating member; and an electric wire unit having a first end extending into said heating member and connected electrically to said electric heating film layer and a second end opposite to said first end and adapted to be connected electrically to an electric power source, wherein said closure unit includes an elongated connecting block which is secured to said first end portion of said heating member and which is formed with a longitudinal slot that permits said second end portion of said heating member to extend therethrough so as to form said heating member into said tubular body, said second end portion of said heating member being slidable relative to said connecting block so as to permit adjustment of diameter of said tubular body, said closure unit further including a stop member secured to said second end portion of said heating member to prevent removal of said second end portion from said connecting block.

2. The electric heating device as claimed in claim 1, wherein said stop member is formed as an elongated strip with a cross-sectional size larger than width of said longitudinal slot.

3. The electric heating device as claimed in claim 1, wherein said flexible sheet of said heating member has opposite peripheral edges which extend between said first and second end portions and which define open ends of said tubular body, said electric heating device further comprising a pair of resilient members mounted respectively on said peripheral edges of said flexible sheet.

4. The electric heating device as claimed in claim 3, wherein each of said resilient members has a first end disposed adjacent to said first end portion of said flexible sheet, and a second end opposite to said first end, said tubular body being adjustable between largest and smallest cross-sectional sizes, said second ends of said resilient members abutting against said connecting block when said tubular body is adjusted to have the smallest cross-sectional size, said stop member abutting against said connecting block when said tubular body is adjusted to have the largest cross-sectional size.

5. The electric heating device as claimed in claim 1, wherein said closure unit includes an elongated connecting block having opposite longitudinal edges secured respectively to said first and second end portions of said heating member.

6. The electric heating member as claimed in claim 5, wherein said flexible sheet of said heating member has a pair of opposite peripheral edges which extend between said first and second end portions and which define open ends of said tubular body, said electric heating device further comprising a pair of resilient members mounted respectively on said peripheral edges, each of said resilient members having one end disposed adjacent to one of said longitudinal edges of said connecting block and another end disposed adjacent to the other one of said longitudinal edges of said connecting block.

7. The electric heating device as claimed in claim 1, wherein said closure unit includes a set of female buttons provided on one of said first and second end portions of said heating member, and a set of male buttons provided on the other one of said first and second end portions of said heating member for engaging releasably and respectively said female buttons.

8. The electric heating device as claimed in claim 1, wherein said upper and lower dielectric layers are each formed from a glass fiber material.

9. The electric heating device as claimed in claim 1, wherein said upper and lower dielectric layers of said heating member have peripheral portions which are sealed to each other so as to cooperatively enclose said electric heating film layer.

10. The electric heating device as claimed in claim 9, wherein said upper and lower dielectric layers are sealed to each other by heat-sealing. further comprising a battery casing connected to said second end of said electric wire unit and adapted for receiving a battery set therein.

11. The electric heating device as claimed in claim 1, further comprising a battery casing connected to said second end of said electric wire unit and adapted for receiving a battery set therein.

12. An electric heating device comprising:

a heating member formed as a flexible sheet with opposite first and second end portions, said heating member including upper and lower dielectric layers and an electric heating film layer which is disposed between said upper and lower dielectric layers and which is adapted to generate heat when supplied with electric power;

a closure unit provided on said first and second end portions of said heating member for connecting said first and second end portions to each other so as to form said heating member into a tubular body and so as to retain a tubular shape of said heating member; and an electric wire unit having a first end extending into said heating member and connected electrically to said electric heating film layer and a second end opposite to said first end and adapted to be connected electrically to an electric power source, wherein said closure unit includes an elongated connecting block having opposite longitudinal edges secured respectively to said first and second end portions of said heating member.

* * * * *